US006098750A

United States Patent [19]

Reynolds et al.

[11] Patent Number: 6,098,750

[45] **Date of Patent: *Aug. 8, 2000**

[54] SAFETY SYSTEM

[75] Inventors: Charles Gregory Reynolds, Franklin; William K. Kiniry, Duxbury, both of Mass.

[73] Assignee: Bay Nets, Inc., Braintree, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/977,069

[22] Filed: Nov. 24, 1997

Related U.S. Application Data

[60] Provisional application No. 60/031,710, Nov. 25, 1996.

[51] Int. Cl.[7] ..... A62B 1/22

[52] U.S. Cl. ..... 182/138; 182/112; 256/DIG. 2

[58] Field of Search ..... 182/112, 113, 182/137, 138, 139, 140; 256/23, DIG. 2

[56] References Cited

U.S. PATENT DOCUMENTS

| | | | |
|---|---|---|---|
| 1,244,670 | 10/1917 | Whitney | 182/113 |
| 2,895,716 | 7/1959 | Veltri | 256/23 |
| 3,527,319 | 9/1970 | Pedley | 182/139 |
| 3,752,262 | 8/1973 | Helms | 182/113 |
| 3,797,827 | 3/1974 | Child | 256/23 X |
| 4,083,535 | 4/1978 | Britt | 256/DIG. 2 X |
| 4,129,197 | 12/1978 | Preston | 182/112 X |
| 4,401,186 | 8/1983 | Dobersch | 182/113 |
| 4,730,810 | 3/1988 | Rambaud | 256/23 X |
| 4,738,335 | 4/1988 | Ishii | 182/138 X |
| 4,787,602 | 11/1988 | Pidgeon | 256/23 |
| 4,852,194 | 8/1989 | Langan | 256/23 X |
| 4,856,615 | 8/1989 | Nusbaum | 182/138 X |
| 4,875,549 | 10/1989 | Denny et al. | 182/138 |
| 4,979,589 | 12/1990 | Sugiyama et al. | 182/138 X |
| 4,979,701 | 12/1990 | Colarik et al. | 256/23 X |
| 4,986,389 | 1/1991 | Halligan, Sr. et al. | 182/138 |
| 5,161,641 | 11/1992 | Nusbaum | 182/138 |
| 5,182,889 | 2/1993 | Johnson | 182/113 X |
| 5,221,076 | 6/1993 | Zust | 182/113 X |
| 5,299,654 | 4/1994 | Duncan | 182/138 |
| 5,402,988 | 4/1995 | Eisele | 256/DIG. 2 X |

*Primary Examiner*—Daniel P. Stodola
*Assistant Examiner*—Richard M. Smith
*Attorney, Agent, or Firm*—Weingarten, Schurgin, Gagnebin & Hayes LLP

[57] ABSTRACT

A safety system which protects the open side of a mezzanine, loading dock or other elevated work area when in use. The safety system is easy to use while requiring only minimal floor space. The safety system comprises two posts, a movable arm having a safety net and associated hardware such that when the safety system is in a first position the opening of the mezzanine or loading dock is substantially covered by the net. When the safety system is in a second position, the arm and net are out of the way, allowing access by workers and machinery to and from the open side. The operation of the safety system from the first position to the second position or vice versa is performed remotely from the open side, thus further reducing the risk of falling.

10 Claims, 7 Drawing Sheets

SAFETY SYSTEM

CROSS REFERENCE TO RELATED APPLICATIONS

This application claims priority under 35 U.S.C. § 119(e) to provisional patent application Ser. No. 60/031,710, filed Nov. 25, 1996, the disclosure of which is incorporated herein by reference.

STATEMENT REGARDING FEDERALLY SPONSORED RESEARCH OR DEVELOPMENT

Not Applicable

BACKGROUND OF THE INVENTION

A warehouse or similar style building typically includes an open-sided mezzanine level which is used for storing pallets of material, as well as a loading dock which is open to the outside at a predetermined height so that trucks, once backed up to the dock, can be easily unloaded. The open sides of the mezzanine and the loading dock pose serious safety risks. A misplaced step by a worker can send the worker over the edge of the mezzanine or loading dock, posing danger to the worker as well as any workers below. A misplaced carton or pallet can also tumble off the mezzanine or loading dock and possibly injure people or materials located below. Injuries resulting from workers or material falling off of open mezzanines and loading docks are one of OSHA's top ten most frequently violated standards.

Previous attempts to reduce the risk of open-sided mezzanines and loading docks have proven relatively unsuccessful. Yellow warning lines painted on the floor have achieved limited results at best. Steel fencing systems have proven effective when closed, but require a great deal of floor space since they typically are swung into and out of position. Further, operating a steel fence system places a worker at the edge of the mezzanine or loading dock, creating a safety hazard of its own. The opening and closing of steel systems require substantial time by one or more employees and as such are costly to use as well as to purchase. Workers tend to avoid using safety systems which interrupt work flow, and when a safety system is not used, it can not afford protection.

BRIEF SUMMARY OF THE INVENTION

A safety system is disclosed which protects the open side of a mezzanine, loading dock or other elevated work area when in use. The safety system is easy to use while requiring only minimal floor space. The safety system comprises two posts, a movable arm having a safety net and associated hardware such that when the safety system is in a first position the opening of the mezzanine or loading dock is substantially covered by the net. When the safety system is in a second position, the arm and net are out of the way, allowing access by workers and machinery to and from the open side. The operation of the safety system from the first position to the second position or vice versa is performed remotely from the open side, thus further reducing the risk of falling.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
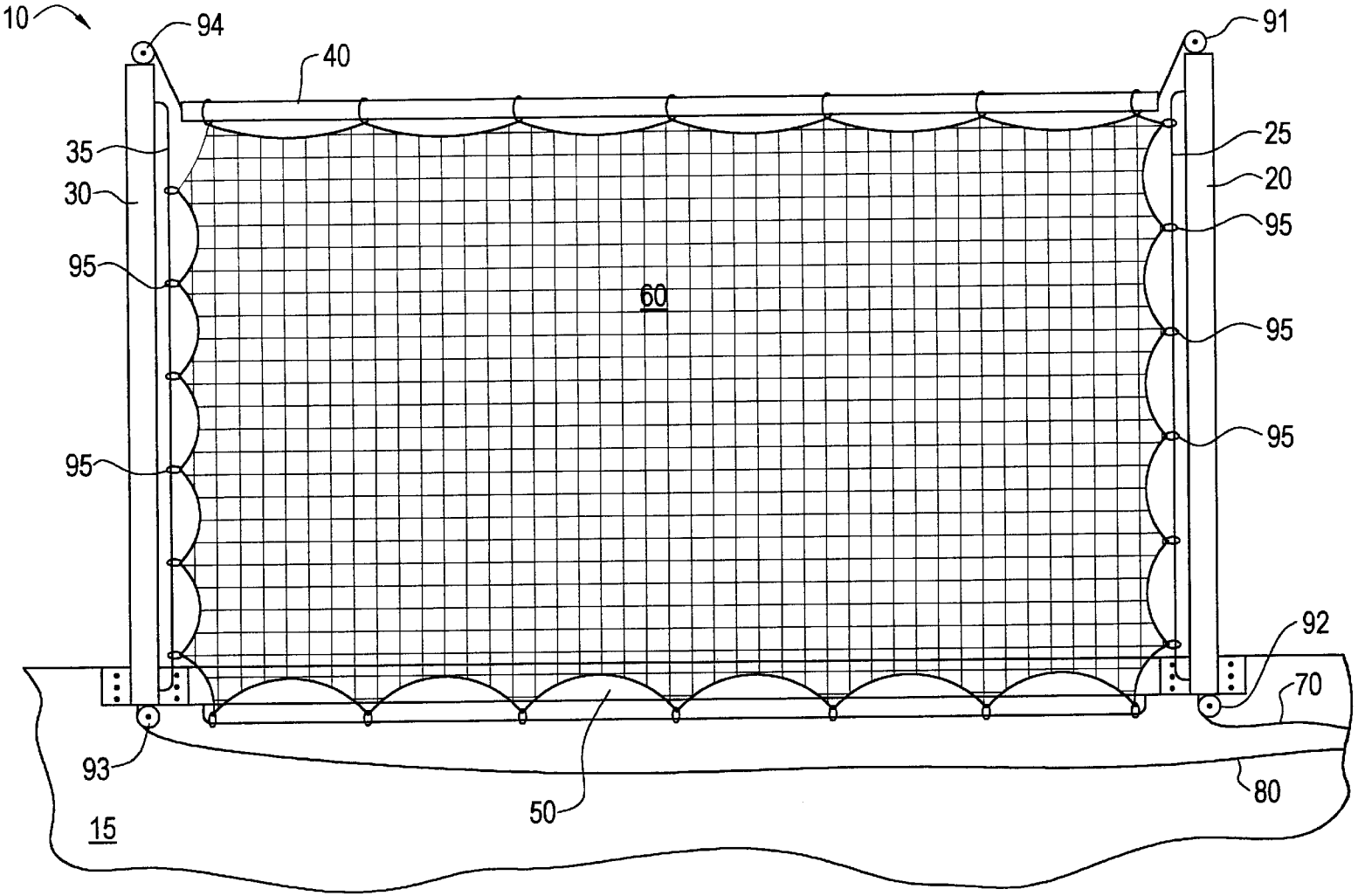
FIG. 1 is a front view of a first embodiment of the safety system in the closed position.

Referring to FIG. 1, a first embodiment of a safety system 10 for use with a mezzanine opening or other elevated work area is shown. In warehouses, mezzanine shelving is typically used to hold inventory. The inventory is typically placed on the shelving with a fork lift. Often, employees must also work on these upper levels to maneuver the inventory. A fall hazard arises when employees work in the area between the inventory and the edge of the shelving. Employers are required to protect their employees from such a fall hazard. However, it is difficult to put up a barrier to keep people from falling because it interferes with the operation of the fork lift.

The system 10 in this embodiment comprises two generally vertical posts 20 and 30, a generally horizontal top arm 40, a bottom assembly 50, a safety net 60, a cable system and associated hardware. The posts 20 and 30 are permanently secured to a structure 15 such as the mezzanine floor and may include a guide rod 25 and 35 for moveable securement of the safety net 60. The safety net 60 is suspended between the posts 20 and 30, the top arm 40 and the bottom assembly 50 by spring snap links 95 or the like. A first rope or cable 70 is strung from the ground level, over first pulley 92 disposed at the bottom of post 20, through the post 20, over a second pulley 91 disposed at the top of the post and attached to one end of the top arm 40. A second rope or cable 80 is strung from the ground level, over third pulley 93 disposed at the bottom of post 30, through the post 30, over a fourth pulley 94 disposed at the top of the post 30 and attached to a second end of the top arm 40. Additional pulleys may also be utilized to further guide the cables.

The bottom assembly is secured between the bottom of the posts 20 and 30. The bottom assembly can be an arm, a plurality of anchors fixed to the structure, or a cable extending between the posts 20 and 30.

The first cable 70 and second cable 80 allow for movement of the top arm from a first position wherein the top arm is disposed between the top of the posts, and a second position wherein the top arm is disposed between the bottom of the posts 20 and 30.

When the top arm is disposed at it's first position, the safety net 60 substantially covers an opening defined by the posts 20 and 30, the bottom assembly 50, and the top arm 40. In such a position the risk that a worker or material will fall off the mezzanine shelf is greatly reduced.

Figure 2:
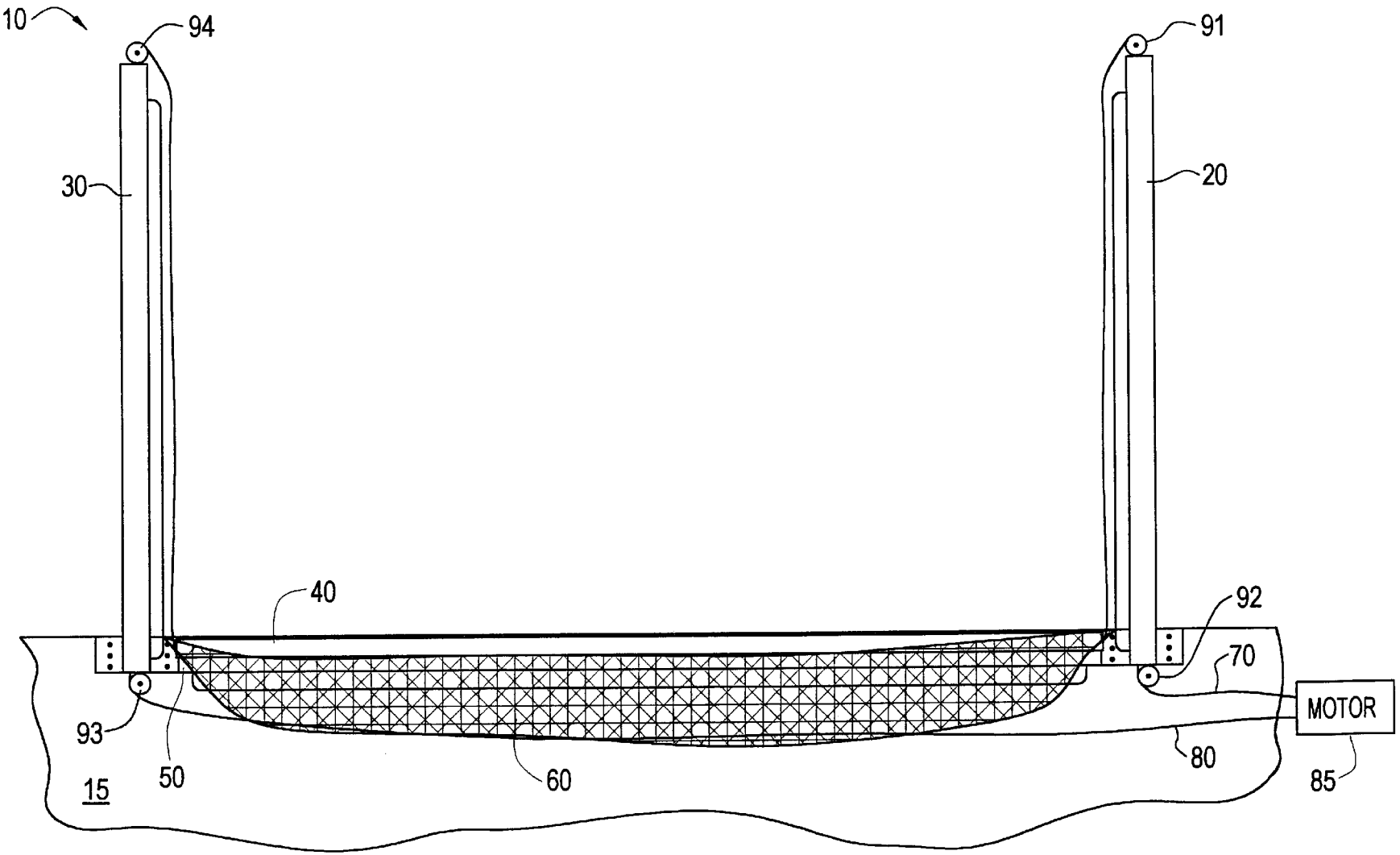
FIG. 2 is a front view of the safety system of FIG. 1 shown in the open position.

When the cables 70 and 80 are extended, the weight of the top arm 40 causes the system to retract, with the top arm and safety net falling below the top surface of the mezzanine shelf as shown in FIG. 2. In this second position the safety net 60 is out of the way, and allows access between the posts 20 and 30 by people or machinery. The cables 70 and 80 allow for the movement of the top arm from the first position to the second position. The cables are secured such as by being tied to "c cleats", fixed in position by operation of cable locks, or by some other securing device. A motor 85 may be used to provide for extension and retraction of the cables. The cables allow for operation of the safety system between its first and second positions remotely from the opening, thereby removing a safety risk to the operator.

Figure 3:
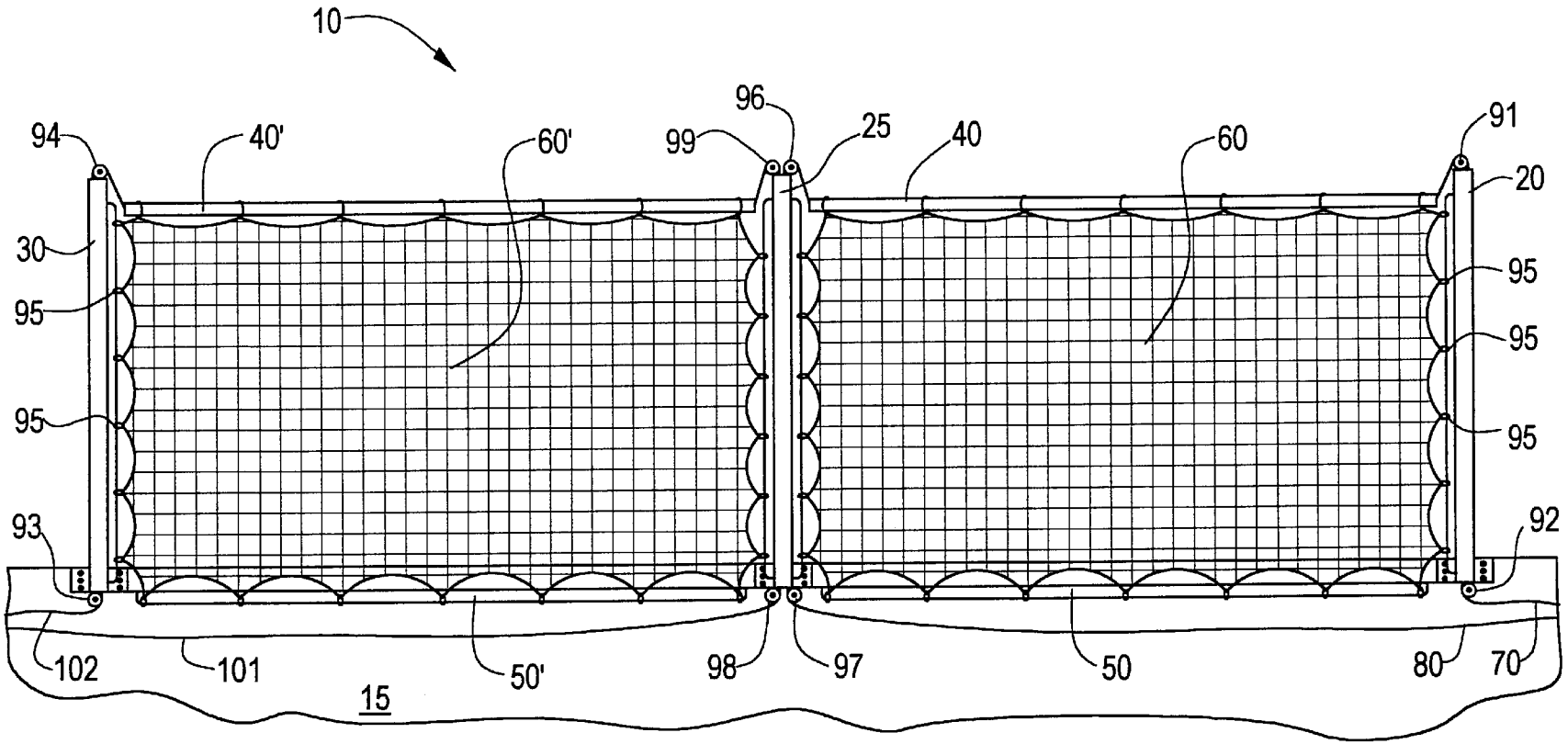
FIG. 3 is a front view of an embodiment of a safety system including multiple posts.
Figure 4:
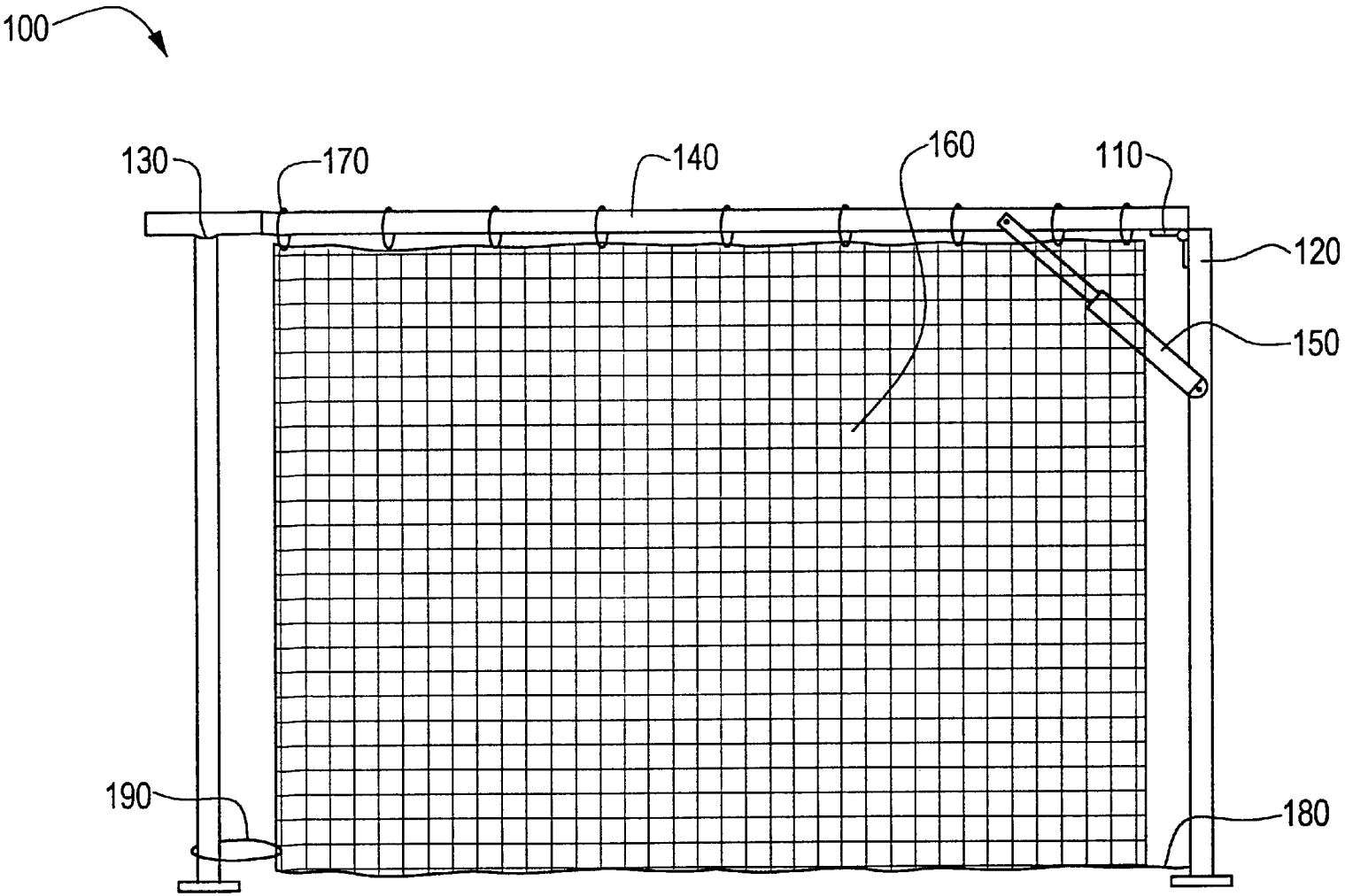
FIG. 4 is a front view of a second embodiment of the safety system in the closed position.
Figure 5:
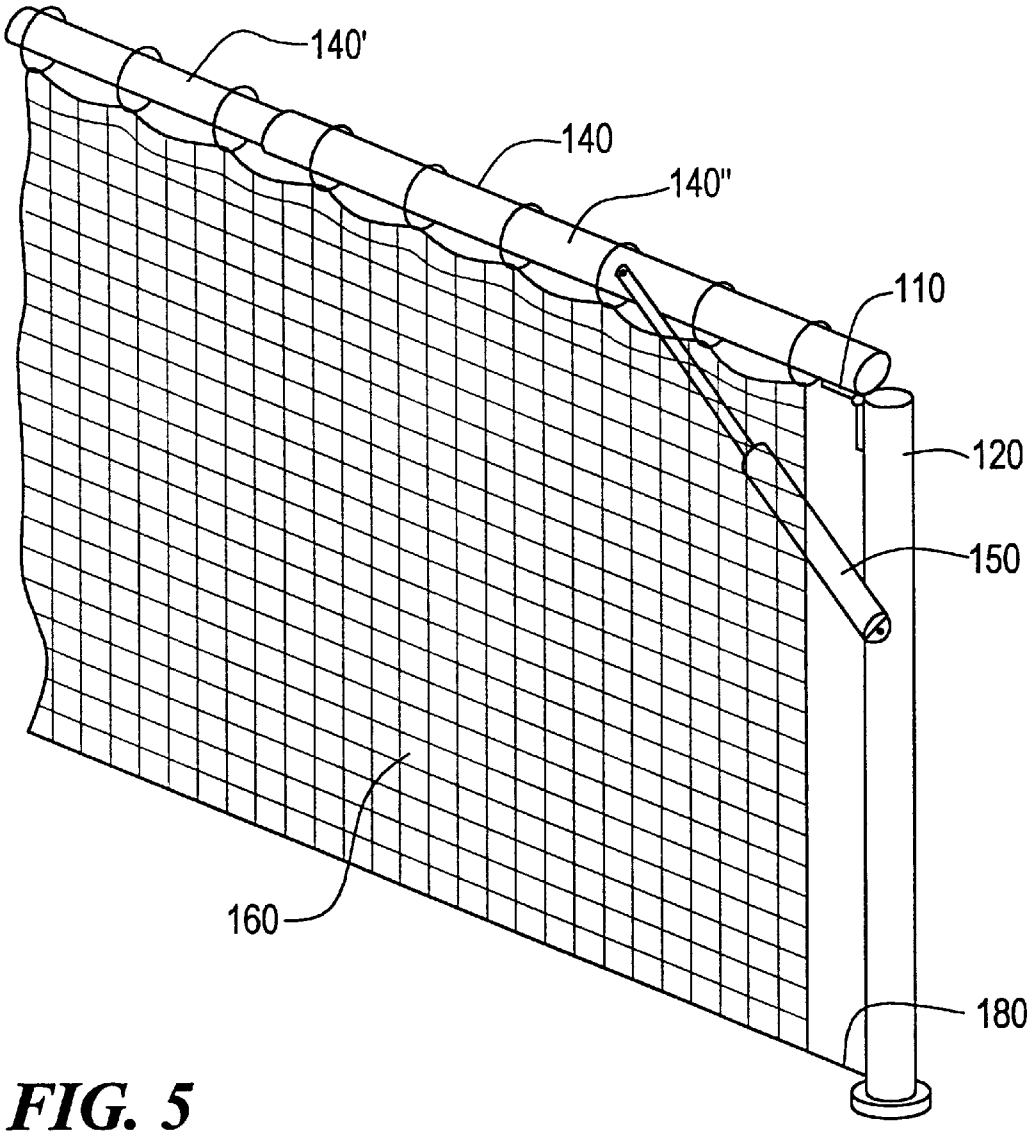
FIG. 5 is a front view of the safety system of FIG. 4 in a partially open position.
Figure 5:
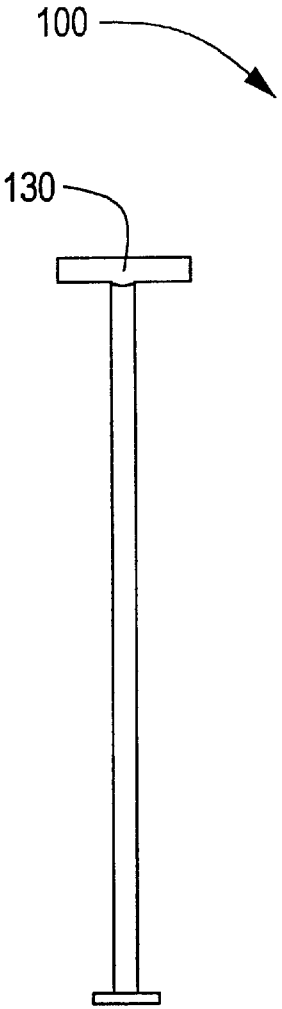
Figure 6:
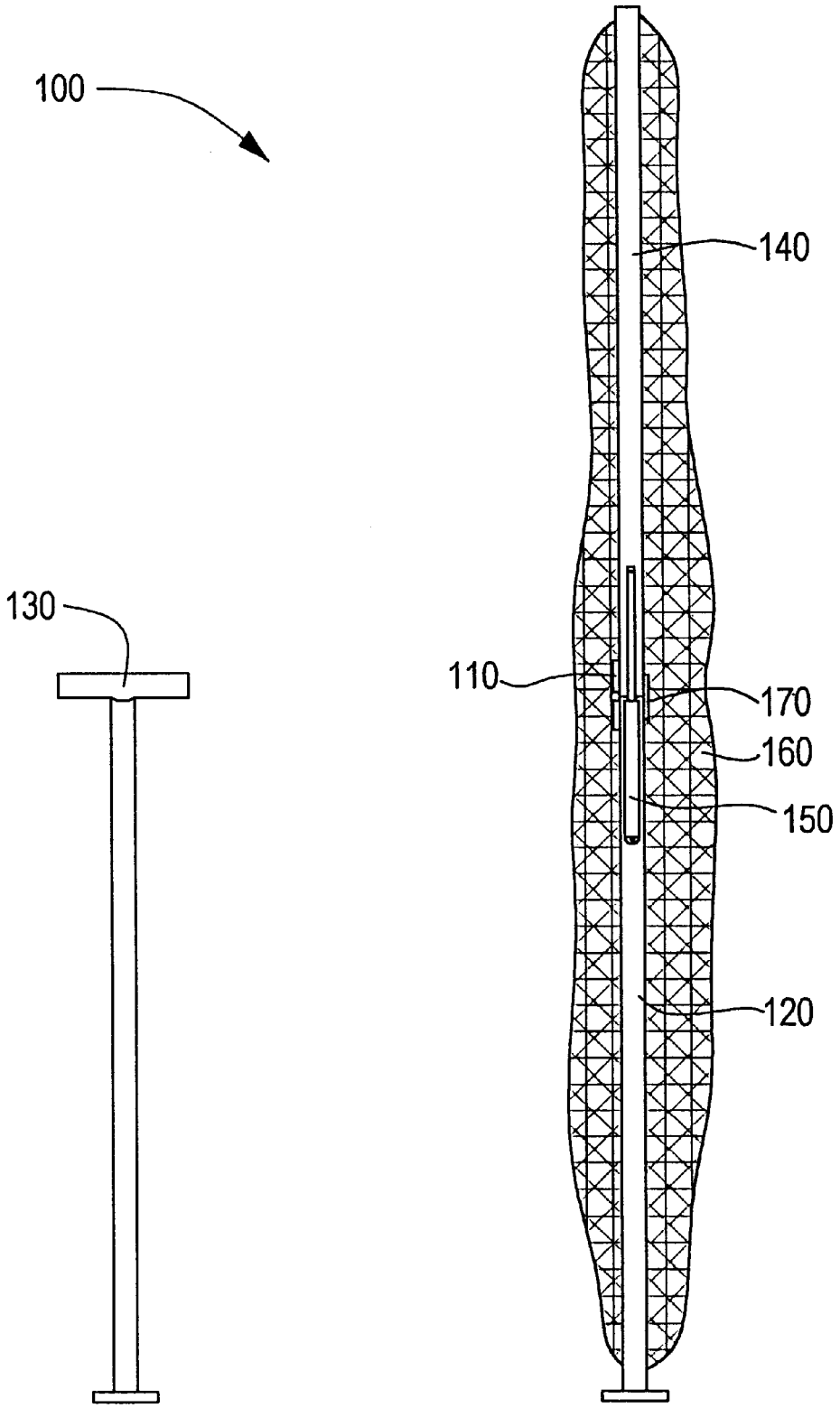
FIG. 6 is a front view of the safety system of FIG. 4 in the open position.

Referring now to FIG. 3, a series of safety systems 10 are shown installed along an upper level. While only two systems are shown, it should be realized that any number of systems could be connected together using a plurality of safety nets, center posts, a left post, a right post and associated hardware.

The system in this embodiment comprises two generally vertical posts 20 and 30, a center post 25, a pair of generally horizontal top arms 40 and 40', a pair of bottom assemblies 50 and 50', a pair of safety nets 60 and 60', and associated hardware. The posts 20 and 30 are permanently secured to a structure 15 such as the mezzanine floor as is center post 25. Safety net 60 is suspended between the posts 20 and 25, the top arm 40 and the bottom assembly 50 by spring snap links 95 or the like. Safety net 60' is suspended between the posts 30 and 25, the top arm 40' and the bottom assembly 50' by spring snap links 95 or the like.

A first rope or cable 70 is strung from the ground level, over first pulley 92, through the post 20, over a second pulley 91 disposed at the top of the post 20 and attached to a first end of the top arm 40. A second rope or cable 80 is strung from the ground level, over a third pulley 97 disposed at the bottom of the center post 25, through the center post 25, over a fourth pulley 96 disposed at the top of the post 25 and attached to a second end of the top arm 40. A third cable 101 is strung from the ground level, over a fifth pulley disposed at the bottom of the center post 25, through the center post 25, over a sixth pulley 99 disposed at the top of the center post 25 and attached to a first end of the top arm 40'. A fourth cable 102 is strung from the ground level, over seventh pulley 93 disposed at the bottom of post 30, through the post 30, over an eighth pulley 94 disposed at the top of the post 30 and attached to a second end of the top arm 40'.

The bottom assembly 50 is disposed between the bottom of the posts 20 and 25. The bottom assembly 50' is disposed between the bottom of posts 25 and 30. The bottom assemblies can be an arm, a plurality of anchors fixed to the structure, or a cable extending between the posts 20 and 25, and between the posts 25 and 30.

The first cable 70 and second cable 80 allow for movement of the top arm 40 from a first position wherein the top arm is disposed between the top of the posts 20 and 25, and a second position wherein the top arm 40 is disposed between the bottom of the posts 20 and 25. The third cable 101 and fourth cable 102 allow for movement of the top arm 40' from a first position wherein the top arm 40' is disposed between the top of the posts 25 and 30, and a second position wherein the top arm 40' is disposed between the bottom of the posts 25 and 30.

When the top arms are disposed at their first position, the safety net 60 substantially covers an opening defined by the posts 20 and 25, the bottom assembly 50, and the top arm 40. Also in such a position the safety net 60' substantially covers an opening defined by the posts 25 and 30, the bottom assembly 50' and the top arm 40'. In such a position the risk that a worker or material will fall off the mezzanine shelf is greatly reduced.

When the cables 70 and 80 are extended, the weight of the top arm 40 causes the system to retract, with the top arm 40 and safety net 60 falling below the top surface of the mezzanine shelf. In this second position the safety net 60 is out of the way, and allows access between the posts 20, 30 by people or machinery. Similarly, when the cables 101 and 102 are extended, the weight of the top arm 40' causes the system to retract, with the top arm 40' and safety net 60' falling below the top surface of the mezzanine shelf. In this second position the safety net 60' is out of the way, and allows access between the posts 20 and 25 or 25 and 30 by people or machinery. The operation of moving the system between the first and second positions can occur independently. For example, thus safety net 60 could be in the first position while safety net 60' is in the second position.

Referring now to FIGS. 4–7 a further embodiment 100, in this instance for a loading dock or other elevated work area, is shown. The loading dock safety system 100 is used to keep people from falling off of elevated loading docks when the bay door is open and there is no truck covering the opening. The system 100 is readily employed and deployed, multiple times per day. The system 100 is out of the way of the business activities at the facility when not in use.

In this embodiment the safety system 100 comprises a lower arm or post 120 secured to a floor or other structure just inside one side of the elevated loading dock door. Attached to this lower post 120 is a hinged upper arm or post 140. The upper arm 140 may be telescopic such that a first section 140' of the upper arm is receivable within a second section 140" of the upper arm. The safety net 160 is secured to the upper arm with circular links. The upper arm is movable between a first position and a second position.

In the first position, the upper arm 140 is generally horizontal and is extended across the entire opening of the bay door (not shown) and attached to another post or reception arm 130 permanently mounted to the floor just inside the other side of the elevated loading dock door. A portion of the safety net 160 is permanently attached at the top to the outer most point of the arm so that the net 160 slides open and closed with the arm and does not bunch up when the arm is raised. Furthermore, the bottom corner, closest to the hinged post is permanently affixed to the hinged post by link 180. The opposite bottom corner is removably attached to the receiving post, via a spring snap link 190, each time the arm is engaged and disengaged. In the first position the safety net substantially covers the loading dock opening, and greatly reduces the risk of a worker or material falling off the loading dock.

In the second position, the arm is raised upright so as to be out of the way of the door (similar to a rail road crossing gate). The upper arm 140 can be locked in this position by lock 170. When the safety system 100 is to be engaged, the arm is unlocked from its first upright position and lowered to its second generally horizontal position. A pressurized shock 150 may be included to assist in the lifting and lowering of the upper arm.

Figure 7:
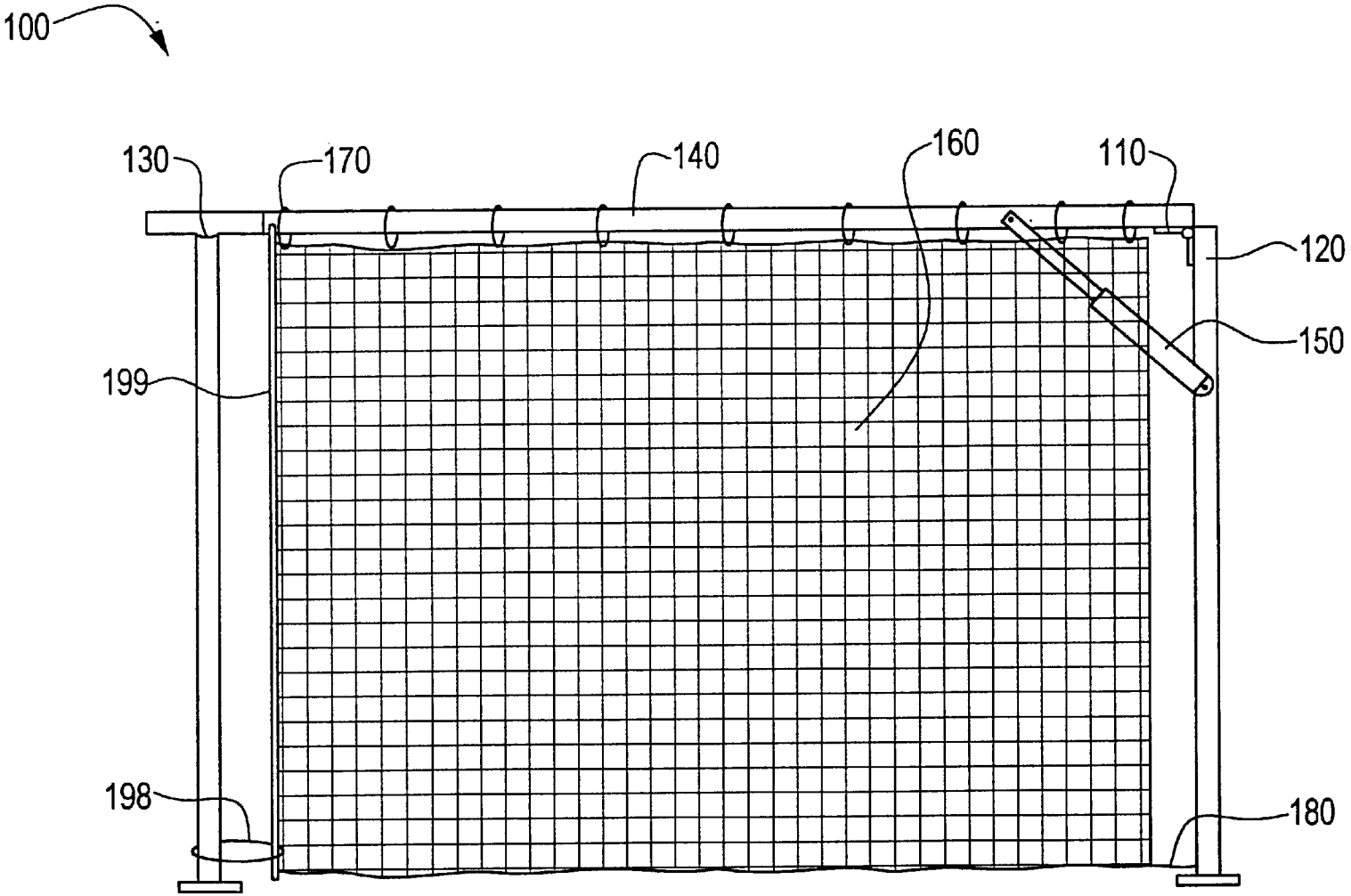
FIG. 7 is a front view of a further embodiment of the safety system of FIG. 4.

Referring now to FIG. 7, the safety system is shown including a guide rod 199. Guide rod 199 is pivotally mounted to upper arm 140, and keeps the safety net 160 extended across the opening when the upper arm 140 is extended. The guide rod 199 is received by receptacle 198 and is maintained therein, thus removing the need to manually connect the corner of the net to the receiving arm 130.

Having described preferred embodiments of the invention it will now become apparent to those of ordinary skill in the art that other embodiments incorporating the concepts of the present invention could also be utilized. Accordingly, it is submitted that the invention should not be limited to the described embodiment but rather should be limited only by the scope and spirit of the appended claims.

What is claimed is:

1. A safety system for protecting an open side of a work area positioned on an upper surface of an elevated structure comprising:

a first post having a top end and a bottom end, said bottom end of said first post capable of being secured to said structure;

a second post having a top end and a bottom end, said bottom end of said second post capable of being secured to said structure, said second post disposed a predetermined distance away from said first post;

a top arm having a first end and a second end, disposed between said first post and said second post, said top arm movable between a first position wherein said top arm is positioned between said top end of said first post and said top end of said second post and a second position wherein said top arm is positioned between said bottom end of said first post and said bottom end of said second post and below said upper surface of said structure;

a bottom assembly disposed between said bottom end of said first post and said bottom end of said second post, and directly below said second position of said top arm;

a net having a left side, a right side, a bottom side and a top side, said top side of said net secured to said top arm, said bottom side of said net secured to said bottom assembly, said left side of said net movably secured to said first post, and said right side of said net movably secured to said second post; and a cable assembly comprising a first cable having a first end and a second end, said first end of said first cable secured to said first end of said top arm, said second end of said first cable extending through and beyond said first vertical post, and a second cable having a first end and a second end, said first end of said second cable secured to said second end of said top arm, said second end of said second cable extending through and beyond said second vertical post, said top arm in communication with said cable assembly exclusively at said first and second ends of said top arm, said cable assembly for moving said top arm between said first position wherein said net is disposed substantially covering an opening defined by said first post, said second post, said top arm and said bottom assembly and said second position wherein said net is disposed below said upper surface of said structure between said first post and said second post and directly beneath said defined opening and said first and second cables and further wherein said first and second cables are disposed proximate to respective said first and second vertical posts so that movement of workers and machinery into and out of said work area between said first post and said second post is unobstructed.

2. The safety system of claim 1 wherein said net comprises nylon.

3. The safety system of claim 1 wherein said cables comprise aircraft cable.

4. The safety system of claim 1 further comprising a motor and wherein said cables are driven by said motor.

5. The safety system of claim 1 further comprising a plurality of snap rings for securing said net to said first post, said second post, said top arm and said bottom assembly.

6. The safety system of claim 1 wherein said first post includes a first guide rod, and wherein said left side of said net is movably secured to said first guide rod.

7. The safety system of claim 1 wherein said second post includes a second guide rod, and wherein said right side of said net is movably secured to said second guide rod.

8. The safety system of claim 1 further comprising a first pulley disposed adjacent said top end of said first post, a second pulley disposed adjacent said bottom end of said first post, a third pulley disposed adjacent said top end of said second post and a fourth pulley disposed adjacent said bottom end of said second post, and wherein said first and second pulleys guide said first cable, and said third and fourth pulleys guide said second cable.

9. The safety system of claim 1 wherein said bottom assembly comprises a lower arm disposed between said first post and said second post.

10. A safety system for protecting the open sides of adjacent first and second work areas positioned on an upper surface of an elevated structure comprising:

a first post having a top end and a bottom end, said bottom end of said first post capable of being secured to said structure;

a second post having a top end and a bottom end, said bottom end of said second post capable of being secured to said structure, said second post disposed a predetermined distance away from said first post;

a center post having a top end and a bottom end, said bottom end of said center post capable of being secured to said structure, said center post disposed between said first post and said second post;

a first top arm having a first end and a second end, disposed between said first post and said center post, said first top arm movable between a first position wherein said first top arm is positioned between said top end of said first post and said top end of said center post and a second position wherein said first top arm is positioned between said bottom end of said first post and said bottom end of said center post and below said upper surface of said structure;

a first bottom assembly disposed between said bottom end of said first post and said bottom end of said center post, and directly below said second position of said first top arm;

a first net having a left side, a right side, a bottom side and a top side, said top side of said first net secured to said first top arm, said bottom side of said net secured to said first bottom assembly, said right side of said net movably secured to said first post, and said left side of said net movably secured to said center post;

a second top arm having a first end and a second end, disposed between said second post and said center post, said second top arm movable between a first position wherein said second top arm is positioned between said top end of said center post and said top end of said second post and a second position wherein said second top arm is positioned between said bottom end of said center post and said bottom end of said second post and below said upper surface of said structure;

a second bottom assembly disposed between said bottom end of said second post and said bottom end of said center post, and directly below said second position of said second top arm;

a second net having a left side, a right side, a bottom side and a top side, said top side of said second net secured to said second top arm, said bottom side of said second net secured to said second bottom assembly, said right side of said second net movably secured to said center post, and said left side of said second net movably secured to said second post; and a cable assembly comprising a first cable having a first end and a second end, said first end of said first cable secured to said first end of said first top arm, said second end of said first cable extending through and beyond said first vertical post, and a second cable having a first end and a second end, said first end of said second cable secured to said second end of said first top arm, said second end of said second cable extending through and beyond said center vertical post, said first top arm in communication with said cable assembly exclusively at said first and second ends of said first top arm, said cable assembly for independently moving said first top arm between said first position wherein said first net is disposed substantially covering a first opening defined by said first post, said center post, said first top arm and said first bottom assembly and said second position wherein said first net is disposed below said upper surface of said structure between said first post and said center post and directly beneath said defined first opening and further wherein said first and second cables are disposed proximate to respective said first and center vertical posts so that movement of workers and machinery into and out of said first work area between said first post and said center post is unobstructed and said cable assembly further comprising a third cable having a first end and a second end, said first end of said third cable secured to said first end of said second top arm, said second end of said third cable extending through and beyond said center vertical post, and a fourth cable having a first end and a second end, said first end of said fourth cable secured to said second end of said second top arm, said second end of said fourth cable extending through and beyond said second vertical post, said second top arm in communication with said cable assembly exclusively at said first and second ends of said second top arm, said cable assembly for independently moving said second top arm between said first position wherein said second net is disposed substantially covering a second opening defined by said center post, said second post, said second top arm and said second bottom assembly and said second position wherein said second net is disposed below said upper surface of said structure between said center post and said second post and directly beneath said defined second opening and further wherein said third and fourth cables are disposed proximate to respective said center and second vertical posts so that movement of workers and machinery into and out of said second work area between said center post and said second post is unobstructed.

* * * * *